US007553783B2

(12) United States Patent
Tanaka

(10) Patent No.: US 7,553,783 B2
(45) Date of Patent: Jun. 30, 2009

(54) CLEANING SHEET

(75) Inventor: Yoshinori Tanaka, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 274 days.

(21) Appl. No.: 10/995,941

(22) Filed: Nov. 24, 2004

(65) Prior Publication Data

US 2005/0136775 A1 Jun. 23, 2005

(30) Foreign Application Priority Data

Dec. 1, 2003 (JP) ..... 2003-401277
Sep. 30, 2004 (JP) ..... 2004-285814

(51) Int. Cl.
*D04H 1/70* (2006.01)

(52) U.S. Cl. ..... 442/327; 15/118; 15/209.1; 15/228; 15/229.1; 15/231; 428/77; 428/189

(58) Field of Classification Search ..... 428/77, 428/189; 15/209.1, 228, 229.1, 231, 118; 442/327
See application file for complete search history.

(56) References Cited

U.S. PATENT DOCUMENTS 4,508,113 A * 4/1985 Malaney ..... 128/849
6,013,349 A * 1/2000 Takeuchi et al. ..... 428/152
6,087,551 A * 7/2000 Pereira ..... 604/367
6,319,593 B1 * 11/2001 Kenmochi et al. ..... 428/198
6,513,184 B1 * 2/2003 Brown et al. ..... 15/231
6,807,702 B2 * 10/2004 Keck et al. ..... 15/104.94
2001/0031953 A1 * 10/2001 Taneichi et al. ..... 604/366
2002/0065012 A1 * 5/2002 Takabayashi et al. ..... 442/381
2003/0003831 A1 * 1/2003 Childs et al. ..... 442/340

FOREIGN PATENT DOCUMENTS

| | | |
|---|---|---|
| JP | 62-13008 | 3/1987 |
| JP | 2507300 | 5/1996 |
| JP | 2516320 | 8/1996 |
| JP | 09-075284 | 3/1997 |
| JP | 09-187411 | 7/1997 |
| JP | 10-286206 | 10/1998 |
| JP | 11-206661 | 8/1999 |
| JP | 2000-507480 | 6/2000 |
| JP | 3042737 | 10/2000 |
| JP | 2001-506519 | 5/2001 |
| JP | 2003-024254 | 1/2003 |
| JP | 2004-033237 | 2/2004 |

* cited by examiner

*Primary Examiner*—Andrew T Piziali
*Assistant Examiner*—Peter Y Choi
(74) *Attorney, Agent, or Firm*—Morrison & Foerster LLP

(57) ABSTRACT

Disclosed is a cleaning sheet which has low frictional resistance to an object to be cleaned and is effective in removing various types of dirt and dust when used in a liquid retaining state. The cleaning sheet to be supported by a support member of a holder includes a first cleaning region containing a liquid retaining member and second cleaning regions where fibrous wiper portions consisting essentially of synthetic resin fibers are exposed externally. When used for cleaning with the liquid retaining member being impregnated with liquid, the first cleaning region can effect cleaning in a wet state, while the fibrous wiper portions can be kept in a nearly dry state so as to be effective in collecting lint, hair and the like.

9 Claims, 5 Drawing Sheets

CLEANING SHEET

BACKGROUND OF THE INVENTION

1. Field of the Invention

The present invention relates to a cleaning sheet for wiping an object to be cleaned; more specifically, this invention relates to a cleaning sheet suitable for use in a state impregnated with liquid such as water.

2. Description of the Related Art

Cleaning sheets designed to be mounted on a mop-like holder for wiping a floor surface or the like have generally been of two types, namely, a liquid retaining type to be used in a state impregnated with liquid (water or cleaning chemical), or a dry type to be used without retention of liquid. The liquid retaining type is suitable for wiping off fine dust attached to a floor surface or the like; the dry type is advantageously effective in removing lint, hair or the like.

Patent Publications 1 to 4 disclose cleaning sheets of the above-mentioned liquid retaining type.

Patent Publication 1 (Japanese Utility-Model Registration No. 2516320) discloses a cleaning sheet with a substrate sheet disposed on a porous polymer for retaining a liquid active material. On its paper surface, the substrate sheet has a flattened outer wiping layer which is formed by thermally fusing thermoplastic fibers or by lamination of a film with pinholes. When used for cleaning, the porous polymer discharges the liquid active material onto the surface of the outer wiping layer.

Patent Publication 2 (Japanese Unexamined Patent Publication No. H10-286206) discloses a cleaning sheet with a liquid-permeable surfacing sheet disposed on a liquid retaining absorbent sheet, wherein the surfacing sheet is formed of a fiber blend including pulp fibers and thermoplastic fibers.

Patent Publication 3 (Japanese Unexamined Patent Publication No. H11-206661) discloses a cleaning sheet composed of a fiber aggregate with irregularities for retaining liquid and a liquid-permeable outer layer sheet covering the fiber aggregate, wherein the outer layer sheet may be spunlaced nonwoven fabric containing hydrophilic fibers.

Patent Publication 4 (Japanese Patent Registration No. 3042737) discloses a cleaning sheet with a microfiber layer entirely formed of microfibers having a fineness of 0.5 denier or less and disposed on a hydrophilic fiber layer formed of cotton fibers, rayon fibers or the like. This cleaning sheet can absorb wet dirt with the hydrophilic fiber layer. Alternatively, the hydrophilic fiber layer may be impregnated with chemical so as to remove dirt with the chemical being fed to the surface of the microfiber layer.

When used in a state impregnated with water or chemical, the cleaning sheets of the conventional liquid retaining type let out the water or chemical all over the cleaning surface. Accordingly, dust attached to a floor surface or the like can be wiped off with the aid of water. However, when a freely movable, relatively large refuse such as lint, hair and the like lies on a floor surface, these cleaning sheets cannot collect the refuse sufficiently only through the adsorptivity of water.

In addition, since water fed to the contact surface of the cleaning sheet against an object to be cleaned, such as floor surface results in formation of water film between the cleaning sheet and the object to be cleaned, resistance will be extremely increased when the cleaning sheet is moved.

In Patent Publication 1, since the surface of the outer wiping layer is flattened by thermally fusing, thermoplastic fibers until they lose the fibrous shape or by lamination of a resin film, the water film between the cleaning sheet and the object to be cleaned increases resistance in wiping operation. In addition, since the cleaning surface is flat, dirt adhered to a floor or the like is difficult to remove.

In Patent Publications 2 and 3, since hydrophilic fibers such as pulp fibers and rayon fibers appear on the cleaning surface to let out absorbed water in a short period of time, these cleaning sheets are unfit for prolonged cleaning. Furthermore, the hydrophilic fibers appearing on the cleaning surface increase frictional resistance to a floor surface or the like, increasing resistance in wiping operation.

In Patent Publication 4, since the cleaning surface is formed only of microfibers having a fineness of 0.5 denier or less, the water film is liable to be formed between the cleaning surface and the object to be cleaned, increasing resistance in wiping operation. Moreover, since the cleaning surface only of such microfibers is substantially flat, the effect of wiping off dirt is deteriorated.

SUMMARY OF THE INVENTION

The present invention has been worked out in view of the shortcomings in the prior art set forth above. It is therefore an object of the present invention to provide a cleaning sheet which is effective in wiping a floor surface or the like without exhibiting high resistance in a liquid retaining state.

According to the present invention, there is provided a cleaning sheet having a cleaning surface intended to come into contact with an object to be cleaned and a holding surface opposite from the cleaning surface, the cleaning sheet comprising a first cleaning region and second cleaning regions on both sides of the first cleaning region, the first cleaning region including a liquid-permeable topsheet appearing on the cleaning surface and a liquid retaining member disposed on a holding surface-side of the topsheet, wherein fibrous wiper portions consisting essentially of synthetic resin fibers and having a lower fiber density than the topsheet appear on the cleaning surface in the second cleaning regions.

In the cleaning sheet of the present invention, water or chemical discharged from the liquid retaining member oozes out of the topsheet in the first cleaning region. However, since the low-density fibrous wiper portions consisting essentially of synthetic resin fibers appear on both sides of the first cleaning region, water oozing out in the first cleaning region can be inhibited from widely spreading on the cleaning surface. This results in low frictional resistance to an object to be cleaned such as floor surface, facilitating wiping operation. Dust attached to a floor surface or the like can be easily removed with the aid of water oozing out in the first cleaning region, while relatively large refuse such as lint, hair and the like lying on a floor surface or the like can be effectively collected by the fibrous wiper portions appearing on both sides of the first cleaning region and retaining less water.

In the present invention, the liquid retaining member may extend into the second cleaning regions.

Preferably, the topsheet consists essentially of synthetic resin fibers so as to improve slipperiness of the topsheet against an object to be cleaned such as floor surface when liquid is discharged from the liquid retaining member. This results in low resistance during cleaning operation. Here, the topsheet may include microfibers having a fineness of 0.011 to 0.77 dtex so as to improve the effect of scraping off dirt adhered to a floor surface or the like. The topsheet may further include relatively thick fibers having a fineness of 1.1 to 5.5 dtex, wherein the relatively thick fibers and the microfibers are split from common original fibers. With a mixture of two kinds of fibers different in thickness, the effect of scraping off dirt can be improved. The topsheet may be a nonwoven fabric in which the synthetic resin fibers are entangled. In this case, liquid permeability of the topsheet may be made moderate to let out liquid in the liquid retaining member over a prolonged period without causing too much ooze.

Preferably, the fibrous wiper portions are portions of a through-air bonded nonwoven fabric located outside the first cleaning region and the through-air bonded nonwoven fabric is directed such that one surface remaining unprocessed with a roller appears on the cleaning surface. In this case, since the fibrous wiper portion has a fluffy (nappy) surface, the fibrous wiper portion has low frictional resistance to a floor surface or the like, facilitating refuse collection. Here, the through-air bonded nonwoven fabric is preferably present between the topsheet and the liquid retaining member in the first cleaning region. Due to its cushioning property, the through-air bonded nonwoven fabric between the topsheet and the liquid retaining member functions to adjust ooze out of the topsheet. Therefore, letting out too much water in a short period of time can be avoided for enabling prolonged cleaning operation.

In the case where the liquid retaining member is not present in the second cleaning regions, at least the topsheet and a substrate sheet, which is disposed on a holding surface-side of the liquid retaining member, may be joined together along boundaries between the first cleaning region and the second cleaning regions. When thus joined, liquid retained by the liquid retaining member in the first cleaning region hardly spreads to the second cleaning regions, so that the second cleaning regions can be kept in a nearly dry state for serving the dust wiping effect. Alternatively, buffer regions where the liquid retaining member is not present may be provided between the first cleaning region and the second cleaning regions and at least the topsheet and the substrate sheet may be joined together along boundaries between the first cleaning region and the buffer regions and along boundaries between the buffer regions and the second cleaning regions. In this case, it becomes more difficult for liquid retained in the first cleaning region to spread to the second cleaning regions.

The first cleaning region may be rectangular and the second cleaning regions may be located along two long sides of the first cleaning region. In this case, when moved along short sides of the first cleaning region for cleaning operation, the cleaning sheet can easily exert both the wet cleaning effect due to the first cleaning region and the dry cleaning effect due to the fibrous wiper portions.

Moreover, attachment regions to be attached to a holder may project laterally beyond the second cleaning regions.

According to the present invention, as has been described hereinabove, the cleaning sheet can exert both the wet cleaning effect due to oozing water and the dry cleaning effect due to the fibrous wiper portions containing less water. In addition, since liquid retained in the liquid retaining member is inhibited from widely spreading, various types of dust and refuse can be removed and collected without exhibiting high frictional resistance.

BRIEF DESCRIPTION OF THE DRAWINGS

The present invention will be understood more fully from the detailed description given hereinafter and from the accompanying drawings of the preferred embodiments of the present invention, which, however, should not be taken to limit to the invention, but are for explanation and understanding only.

In the drawings.

DESCRIPTION OF THE PREFERRED EMBODIMENT

The present invention will be discussed hereinafter in detail in terms of the preferred embodiments according to the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order not to obscure the features of the present invention.

Figure 1:
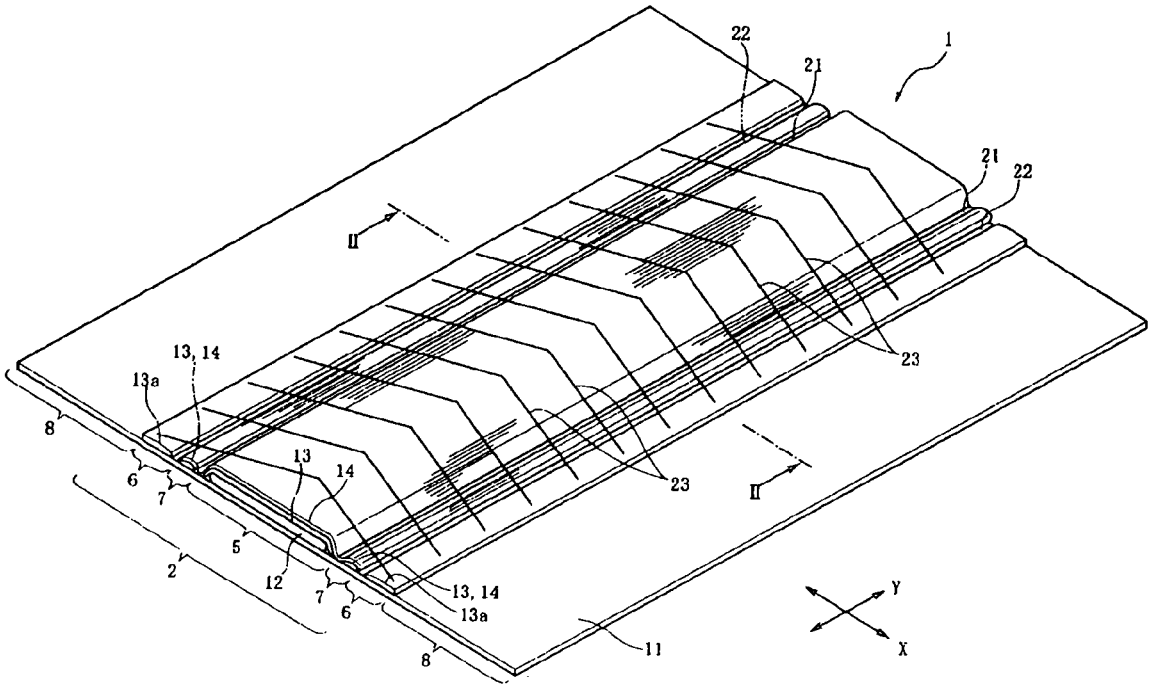
FIG. 1 is a perspective view showing a cleaning sheet according to a first embodiment of the present invention with its cleaning surface directed upward.
Figure 2:
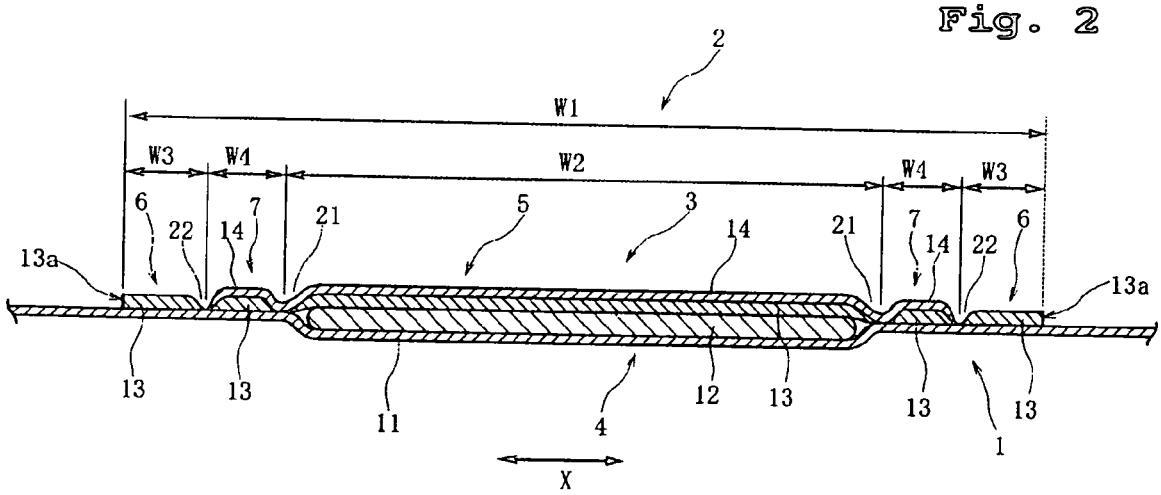
FIG. 2 is a sectional view taken along line II-II of FIG. 1.

FIG. 1 is a perspective view showing a cleaning sheet 1 according to a first embodiment of the present invention with its cleaning surface directed upward; FIG. 2 is a sectional view taken along line II-II of FIG. 1;

The cleaning sheet 1 according to the first embodiment has a cleaning function region 2 over a width W1, as shown in FIG. 2. In the cleaning function region 2, one surface directed upward in FIGS. 1 and 2 is called cleaning surface 3, while the other surface directed downward is called holding surface 4. As shown in FIG. 1, the cleaning function region 2 is rectangular and longer in a Y-direction than in an X-direction to have a length 1.5 times or more the width W1.

The cleaning function region 2 has a first cleaning region 5 of a width W2 and second cleaning regions 6, 6 of a width W3. The first cleaning region 5 is located centrally in the X-direction for retaining water or chemical to be exuded, while the second cleaning regions 6, 6, in which relatively low-density fibrous wiper portions 13*a*, 13*a* appear on the cleaning surface 3, are located on right and left sides of the first cleaning region 5. In the present embodiment, buffer regions 7, 7 of a width W4 are provided between the first cleaning region 5 and the second cleaning regions 6, 6. The buffer regions 7, 7, in which a sheet forming the fibrous wiper portions 13*a*, 13*a* is not exposed externally, do not have the ability to substantially retain liquid.

The first cleaning region 5, the second cleaning regions 6, 6 and the buffer regions 7, 7 are rectangular and extend continuously in the Y-direction, as shown in FIG. 1. More specifically, the second cleaning regions 6, 6 and the buffer regions 7, 7 extend along long sides of the rectangular first cleaning region 5.

The first cleaning region 5 occupies 30 to 95%, preferably 50 to 70%, the area of the cleaning function region 2. The second cleaning regions 6, 6 occupy 5 to 70%, preferably 10 to 50%, the area of the cleaning function region 2. The buffer regions 7, 7 are of the same area as or smaller than the second cleaning regions 6, 6. It should be noted that the buffer regions 7, 7 are not necessarily required in the present invention. With the buffer regions 7, 7, however, water oozing out in the first cleaning region 5 hardly spreads to the second cleaning regions 6, 6, so that the second cleaning regions 6, 6 can be easily maintained in a dry state.

The cleaning sheet 1 has a substrate sheet 11. As shown in FIG. 2, the substrate sheet 11 extends over the cleaning function region 2 to provide the holding surface 4. As shown in FIG. 1, moreover, the substrate sheet 11 projects in the X-direction from both sides of the cleaning function region 2 to provide attachment regions 8, 8 to be attached to a holder 40 (see FIGS. 4 and 5).

These attachment regions 8, 8 may be formed of a sheet other than the substrate sheet 11. For example, a nonwoven fabric 13 that will be described hereinbelow may be further extended from both sides of the cleaning function region 2 to provide the attachment regions 8, 8. In an alternative, an auxiliary sheet such as nonwoven fabric may be joined to the substrate sheet 11 or the nonwoven fabric 13 to provide the attachment regions 8, 8.

In the first cleaning region 5, a liquid retaining member 12 is disposed on the substrate sheet 11, and the nonwoven fabric 13 and a topsheet 14 are stacked one on top of the other on the cleaning surface-side of the liquid retaining member 12. Thus, the first cleaning region 5 is composed of the substrate sheet 11, the liquid retaining member 12, the nonwoven fabric 13 and the topsheet 14.

In each buffer region 7, the nonwoven fabric 13 is located on the substrate sheet 11 and covered with the topsheet 14. In each second cleaning region 6, the nonwoven fabric 13 is located on the substrate sheet 11 and exposed externally to provide the fibrous wiper portion 13*a*. Neither the buffer region 7 nor the second cleaning region 6 is provided with the liquid retaining member 12.

As shown in FIG. 1, compression joins 21 are formed along boundaries between the first cleaning region 5 and the buffer regions 7. Furthermore, compression joins 22 are formed along boundaries between the buffer regions 7 and the second cleaning regions 6. More specifically, two compression joins 21, 21 and two compression joins 22, 22 extend linearly in the Y-direction in a substantially parallel arrangement. However, these compression joins 21, 22 may extend in a curve.

For the compression joins 21, 22, the substrate sheet 11, the nonwoven fabric 13 and the topsheet 14 are compressed together to fusion-bond their constituent fibers through heat-sealing or sonic-sealing. In the compression joins 21, 22, alternatively, the substrate sheet 11, the nonwoven fabric 13 and the topsheet 14 may be bonded together through an adhesive. With the compression joins 22, water oozing out in the first cleaning region 5 hardly spreads to the second cleaning regions 6. Maintaining the second cleaning regions 6 in a dry state is further facilitated by the compression joins 21 that prevent water from spreading from the first cleaning region 5 to the buffer regions 7.

As shown in FIG. 1, the cleaning function region 2 is also formed with a plurality of transverse compression joins 23. The transverse compression joins 23 almost traversing the cleaning function region 2 in the X-direction are arranged at a constant pitch in the Y-direction. The individual transverse compression joins 23 extend in a V-shaped line (or U-shaped line) on the cleaning surface 3 with their crests directed to one side in the Y-direction. Alternatively, the individual transverse compression joins 23 may extend in a wavy line.

In the embodiment shown in FIG. 1, the transverse compression joins 23 extend beyond the first cleaning region 5 into the buffer regions 7 and the second cleaning regions 6, but it is not necessarily required for the transverse compression joins 23 to extend beyond the first cleaning region 5. In the first cleaning region 5, portions enclosed by the compression joins 21 and the transverse compression joins 23 are raised like tablelands.

The substrate sheet 11 may be through-air bonded nonwoven fabric in which heat-fusible synthetic resin fibers are fusion-bonded to each other through a hot air, spunbonded nonwoven fabric in which molten synthetic resin streams extruded through nozzles are fusion-bonded to each other, meltblown nonwoven fabric in which molten synthetic resin streams extruded through nozzles are simultaneously attenuated to have an extremely fine diameter through a high-speed airstream and then fusion-bonded to each other, spunlaced nonwoven fabric, air-laid nonwoven fabric, resin film or combinations thereof.

Preferably, the substrate sheet 11 consists essentially of synthetic resin fibers. That is, it is preferred that the substrate sheet 11 does not contain other fibers such as water-swellable fibers (e.g., cellulosic fibers such as rayon, cotton and pulp).

The liquid retaining member 12 may be formed of a hydrophilic material or a combination of a hydrophilic material and a hydrophobic material. For example, there may be used air-laid pulp in which pulp fibers deposited by the air-laid process are bonded to each other through a binder or air-laid nonwoven fabric in which heat-fusible synthetic resin fibers and pulp fibers deposited by the air-laid process are bonded to each other by thermal fusion-bonding power of the heat-fusible fibers. Here, two or more sheets of the air-laid pulp or air-laid nonwoven fabric may be stacked to have a total basis weight of about 60 to 300 g/m$^2$, but the basis weight of the liquid retaining member 12 should not be construed as limited to this range.

Alternatively, the liquid retaining member 12 may be formed of a stack of absorbent papers such as tissues, a hydrophilic open-cell foamed material such as cellulose sponge, or a layer of compressed deposited pulp.

The nonwoven fabric 13 has a lower fiber density than the topsheet 14 and consists essentially of synthetic resin fibers. That is, the nonwoven fabric 13 does not contain other fibers such as water-swellable fibers (e.g., cellulosic fibers such as rayon, cotton and pulp). In the present embodiment, the nonwoven fabric 13 is through-air bonded nonwoven fabric having a basis weight of 10 to 50 g/m$^2$, in which polyethylene (PP) fibers, polypropylene (PP) fibers, polyethylene terephthalate (PET) fibers, or bicomponent synthetic fibers of such resins are fusion-bonded to each other through a hot air.

This through-air bonded nonwoven fabric is situated such that one surface processed with a roller is directed toward the substrate sheet 11 while the other surface remaining unprocessed with such a roller, i.e., the fluffy (nappy) surface is directed upward in FIGS. 1 and 2. In the second cleaning regions 6, accordingly, the fluffy surface of the through-air bonded nonwoven fabric appears on the cleaning surface 3 to provide the fibrous wiper portions 13*a*. Here since the fibrous wiper portions 13*a*, 13*a* are fixed to the substrate sheet 11 only at the compression joins 22, 23, they are in a relatively freely movable state.

Preferably, the topsheet 14 is liquid-permeable nonwoven fabric which consists essentially of synthetic resin fibers treated to be hydrophilic. That is, it is preferred that the topsheet 14 does not contain other fibers such as water-swellable fibers (e.g., cellulosic fibers such as rayon, cotton and pulp). Here, at least some synthetic resin fibers are heat-fusible.

Figure 6A:
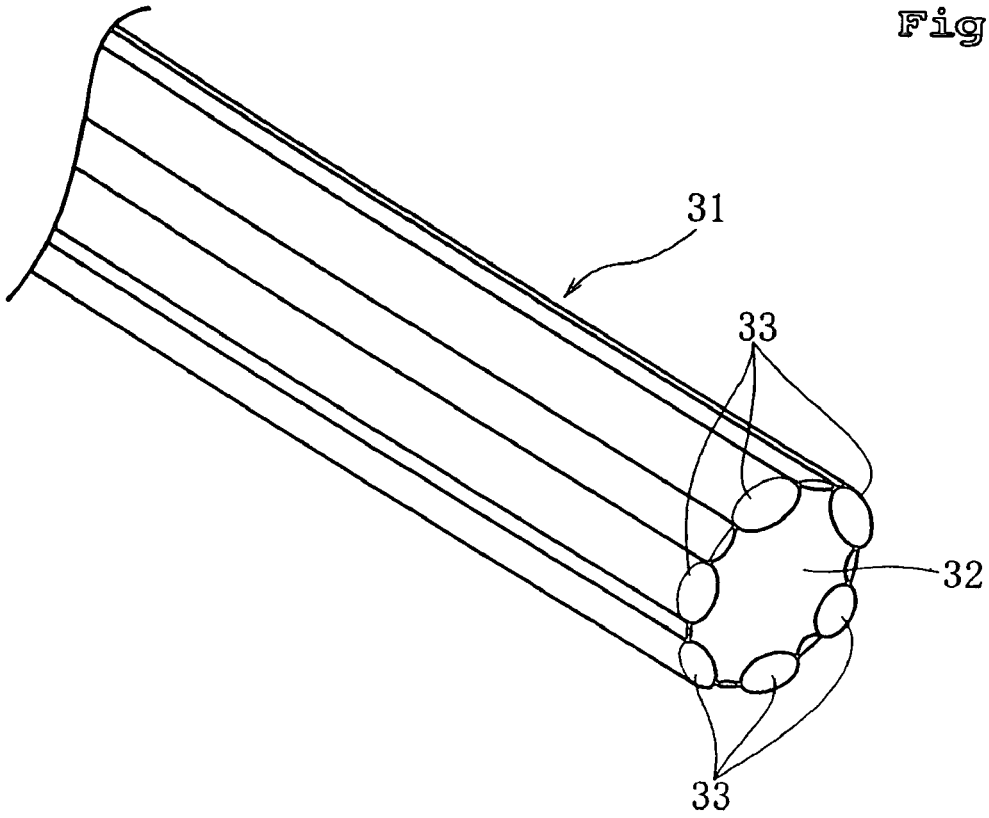
FIGS. 6(A) and 6(B) are schematic views of continuous filaments constituting a topsheet.

In the present embodiment, the topsheet 14 is filament nonwoven fabric formed of continuous filaments such as used for "Alcima" which is the tradename for those developed by UNITIKA LTD., Japan. FIG. 6(A) shows a continuous filament 31 before formation of the filament nonwoven fabric. Continuous filaments 31 are spun with PET microfibers 33 having a fineness of 0.011 to 0.77 dtex (preferably 0.11 to 0.55 dtex) integrally formed around a PE primary fiber (relatively thick fiber) 32 having a fineness of about 1.1 to 5.5 dtex.

The filament nonwoven fabric may be produced by a spunbonding process in which a molten synthetic resin is extruded through a spinnerette to form filaments and the filaments are then laid down and bonded together. Here, the continuous filaments 31 are made hydrophilic by kneading the resin with a surfactant.

Figure 6B:
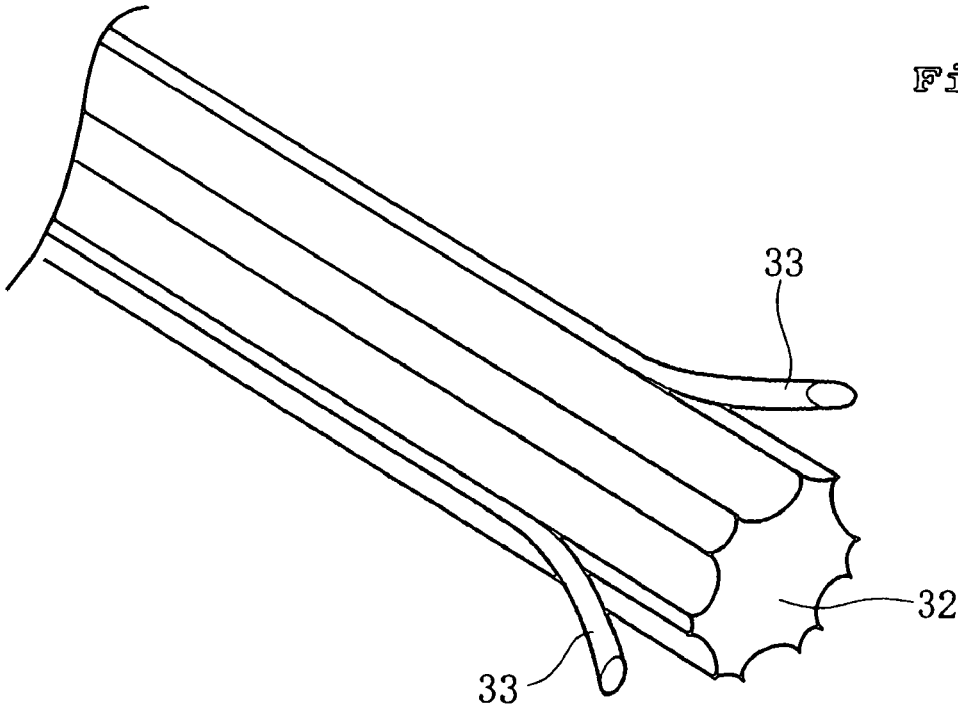

The filament nonwoven fabric thus obtained is fed on a net-like wire conveyor belt and high-pressure water streams are applied thereto through water jet nozzles so that the microfibers 33 are split from the primary fibers 32 as shown in FIG. 6(B) and entangled about each other or about the primary fibers 32. At the same time, a large number of through-holes corresponding to the mesh of the wire conveyor belt are formed in the nonwoven fabric. Thus, the filament nonwoven fabric for the topsheet 14 is hydroentangled (or spunlaced).

In the filament nonwoven fabric, the primary fibers 32 and the microfibers 33 are present in a fiber number ratio of from 1:4 to 1:10. After the microfibers 33 are split from the PE primary fiber 32, the PE primary fiber 32 is of a cross-section having several sharp-pointed projections, as shown in FIG. 6(B).

A basis weight of the filament nonwoven fabric preferably falls within the range of 10 to 100 g/m$^2$, but should not be construed as limited thereto.

Figure 4:
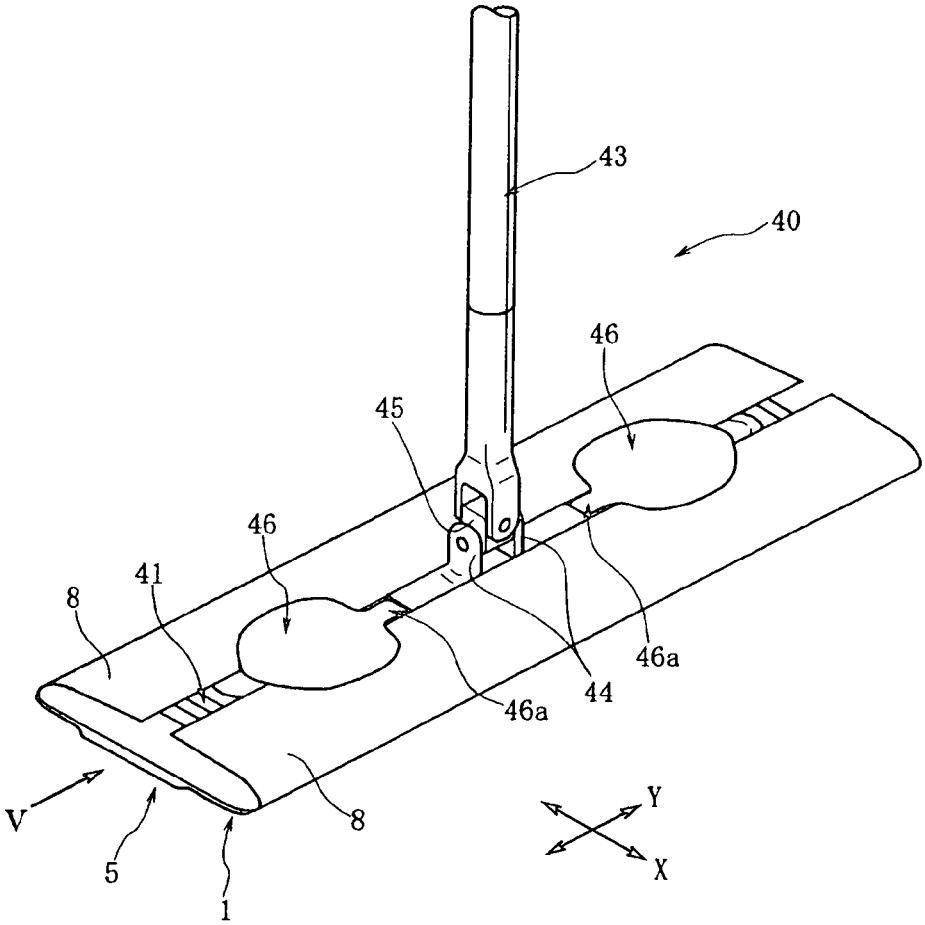
FIG. 4 is a perspective view showing a state where the cleaning sheet of FIG. 1 is mounted on a holder.
Figure 5:
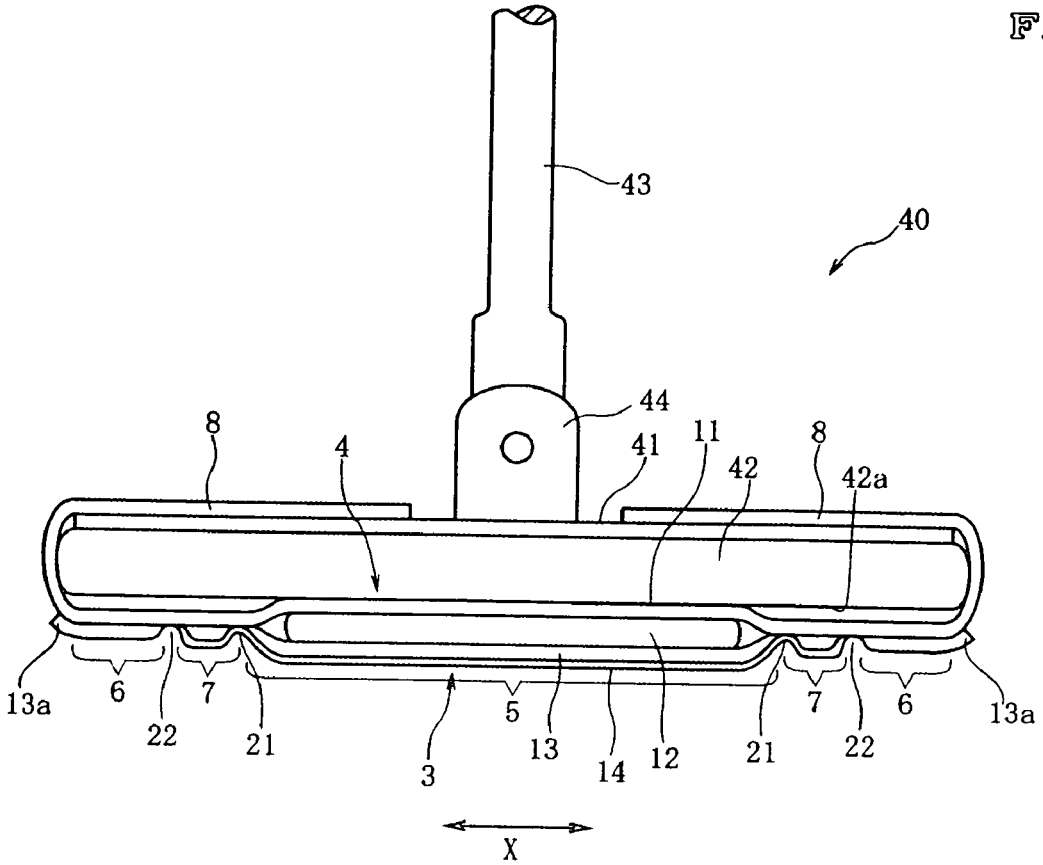
FIG. 5 is an enlarged side view taken in the direction of arrow V of FIG. 4.

When to be used, the cleaning sheet 1 may be mounted on a mop-like holder 40 shown in FIGS. 4 and 5.

The holder 40 is composed of a support plate 41, a support member 42 disposed on a lower surface of the support plate 41, a handle 43 pivotally connected to an upper surface of the support plate 41. A pair of support brackets 44 is integrally formed on the upper surface of the support plate 41. A connecting member 45 is pivotally mounted between the support brackets 44, and a leading end of the handle 43 is pivotally connected to the connecting member 45. As a result, the handle 43 can be freely tilted in any direction.

A pair of fixing members 46, 46 spaced apart from each other in the Y-direction is disposed on the upper surface of the support plate 41. The fixing members 46, 46 are pivotally connected to the support plate 41 at ends 46*a*, 46*a* located close to the handle 43.

As shown in FIG. 5, the cleaning sheet 1 intended to be thrown away after use is mounted such that the holding surface 4 of the cleaning function region 2 is applied to a lower surface 42*a* of the support member 42 to direct downward the cleaning surface 3 of the cleaning function region 2 while the attachment regions 8, 8 are folded back against the upper surface of the support plate 41 and then secured by holding between the upper surface of the support plate 41 and the fixing members 46, 46.

When the cleaning sheet 1 is mounted on the holder 40, therefore, the whole cleaning function region 2 is supported by the lower surface 42*a* of the support member 42, so that the first cleaning region 5, the buffer regions 7, 7 and the second cleaning regions 6, 6 are located on the lower surface 42*a* of the support member 42. More specifically, the first cleaning region 5 is located centrally of the lower surface 42*a* of the support member 42, while the fibrous wiper portions 13*a*, 13*a* of the second cleaning regions 6, 6 are located adjacent the long sides of the lower surface 42*a* of the support member 42. As set forth above, the fibrous wiper portions 13*a*, 13*a* are in a relatively freely movable state.

The cleaning sheet 1 may be used in a dry state, but it is also possible to impregnate the liquid retaining member 12 with water or chemical before use.

When moved along an object to be cleaned such as floor surface in a dry state (i.e., without impregnating the liquid retaining member 12 with water before use), the topsheet 14 of the first cleaning region 5 can remove fine dust with irregularities of the filament nonwoven fabric, while the low-density fibrous wiper portions 13*a*, 13*a* on both sides of the first cleaning region 5 can collect relatively large refuse such as lint, hair and the like. If the floor surface is wet with water, moreover, the water passes through the topsheet 14 and is then absorbed and retained in the liquid retaining member 12.

When moved along a floor surface or the like in a state where the liquid retaining member 12 is retaining water or chemical, on the other hand, water retained in the liquid retaining member 12 can pass through and appear on the topsheet 14 due to pressure exerted during cleaning operation, facilitating removal of dirt adhered to a floor surface or the like, as well as dust. Here, since the filament nonwoven fabric used for the topsheet 14 is of a mixture of the relatively thick primary fibers 32 and the microfibers 33, the topsheet 14 has complex irregularities, enhancing the effect of removing dirt adhered to a floor surface or the like. In addition, the microfibers 33 themselves are effective in removing dirt adhered to a floor surface or the like.

In the filament nonwoven fabric, the primary fibers 32 are generally aligned with each other in a longitudinal direction of the cleaning function region 2 (the Y-direction), so that the dirt removing effect becomes higher when cleaning is performed in the X-direction crossing the fiber extending direction.

In addition, since the topsheet 14 is the filament nonwoven fabric formed of the relatively thick primary fibers 32 and the microfibers 33 and hydroentangled to have a large number of the through-holes, liquid permeability can be made so moderate that water retained in the liquid retaining member 12 can gradually ooze out of the topsheet 14 without causing too much ooze at a time. Accordingly, cleaning can be performed over a prolonged period while moderately wetting the floor surface or the like.

In the first cleaning region 5, as set forth above, the through-air bonded nonwoven fabric 13 is present between the liquid retaining member 12 and the topsheet 14. Due to its cushioning property, the through-air bonded nonwoven fabric 13 functions to adjust pressure on the liquid retaining member 12, letting a moderate amount of water ooze out of the topsheet 14 from the liquid retaining member 12.

As set forth above, hydrophilic fibers such as pulp exist only in the liquid retaining member 12 of the first cleaning region 5, while the buffer regions 7, 7 and the second cleaning regions 6, 6 on both sides of the first cleaning region 5 consist essentially of synthetic resin fibers without containing other fibers such as water-swellable fibers (e.g., cellulosic fibers such as rayon, cotton and pulp). Therefore, water discharged from the liquid retaining member 12 and oozing out in the first cleaning region 5 hardly spreads to the buffer regions 7, 7 and the second cleaning regions 6, 6. This prevents high frictional resistance due to water film formed between the cleaning sheet 1 and a floor surface or the like, facilitating wiping operation.

As set forth above, the fibrous wiper portions 13*a*, 13*a* are disposed in the second cleaning regions 6, 6 with the fluffy surface of the through-air bonded nonwoven fabric 13 directed toward an object to be cleaned. In addition, the fibrous wiper portions 13*a*, 13*a* not covered with the topsheet 14 are in a relatively freely moveable state. Therefore, the fibrous wiper portions 13*a*, 13*a* are effective in collecting relatively large refuse such as lint, hair and the like. Even if water is given to the fibrous wiper portions 13*a*, 13*a*, the wet state cannot last long because they are formed of the low-density through-air bonded nonwoven fabric 13 only of synthetic resin fibers.

Accordingly, the fibrous wiper portions 13*a*, 13*a* can be kept in a nearly dry state so as to be effective over a prolonged period in collecting relatively large refuse such as lint, hair and the like which tends to be gathered about laterally opposing side edges of the support member 42 of the holder 40.

The present invention should not be understood as limited to the foregoing embodiment and various changes may be made therein.

For example, the continuous filaments 31 of FIG. 6(A) may be mechanically beaten to split the microfibers 33 from the primary fibers 32 prior to fiber entanglement with water jets. In this case, the continuous filaments 31 need not extend continuously in the Y-direction, but may be cut into staple.

After the continuous filaments 31 are processed to split the microfibers 33 from the primary fibers 32 as shown in FIG. 6(B) and optionally cut into staple, they may be heated under pressure between heating rolls to provide a filament nonwoven fabric in which the primary fibers 32 and the microfibers 33 are thermally-bonded together. This thermally-bonded nonwoven fabric may also be used for the topsheet 14.

A bundle of the continuous filaments 31 processed to split the microfibers 33 from the primary fibers 32 as shown in FIG. 6(B) may also be used for the topsheet 14. In this case, the constituent fibers remain not thermally-bonded to each other except for the transverse compression joins 23 where they are joined to the substrate sheet 11. Preferably, the topsheet 14 has a basis weight in the range of 50 to 300 g/m$^2$.

For example, spunlaced nonwoven fabric only of synthetic resin fibers, thermally-bonded air-laid nonwoven fabric only of synthetic resin fibers, or the like may be used for the fibrous wiper portions 13*a*, 13*a*, instead of the through-air bonded nonwoven fabric 13. Alternatively, a bundle of continuous filaments (tow) may be used for the fibrous wiper portions 13*a*, 13*a* without being cut into staple. Such continuous filaments may have a fineness within the range of 2.2 to 33 dtex, extend over the entire length of the cleaning function region 2 in the Y-direction, and remain not thermally-bonded to each other except for the transverse compression joins 23 where they are joined to the substrate sheet 11.

Figure 3:
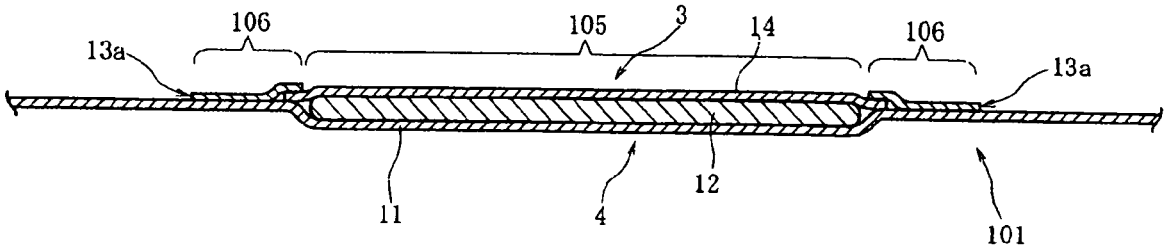
FIG. 3 is a sectional view similar to that of FIG. 2, showing a cleaning sheet according to a second embodiment of the present invention.

FIG. 3 shows a cleaning sheet 101 according to a second embodiment of the present invention.

In the cleaning sheet 101, a first cleaning region 105 is composed of the substrate sheet 11, the liquid retaining member 12 and the topsheet 14 such as filament nonwoven fabric, and second cleaning regions 106, 106 are located on both sides of the first cleaning region 105. The second cleaning regions 106, 106 have the fibrous wiper portions 13*a*, 13*a*. As understood from FIG. 3, the fibrous wiper portions 13*a*, 13*a* according to the second embodiment are formed of separate pieces of through-air bonded nonwoven fabric or the like.

Figure 7:
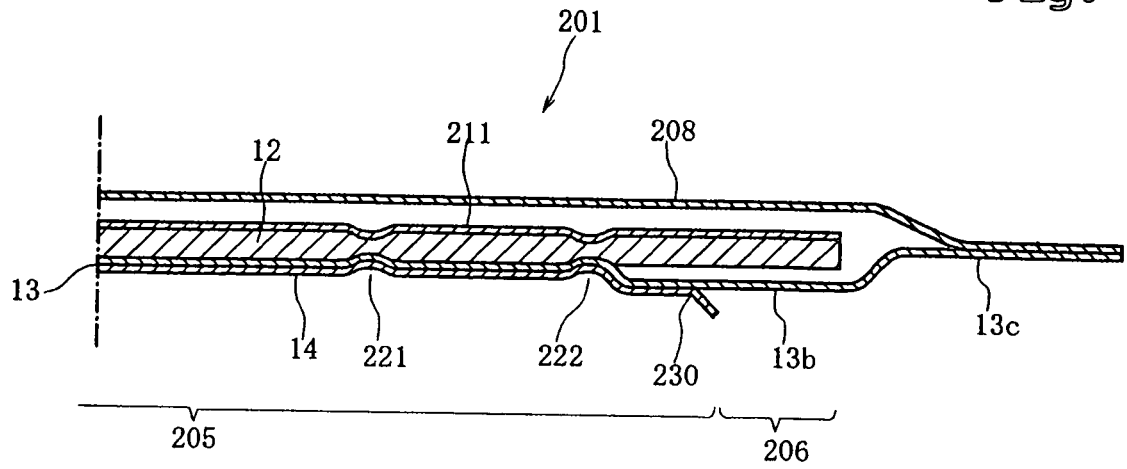
FIG. 7 is a half sectional view showing a cleaning sheet according to a third embodiment of the present invention.
Figure 8:
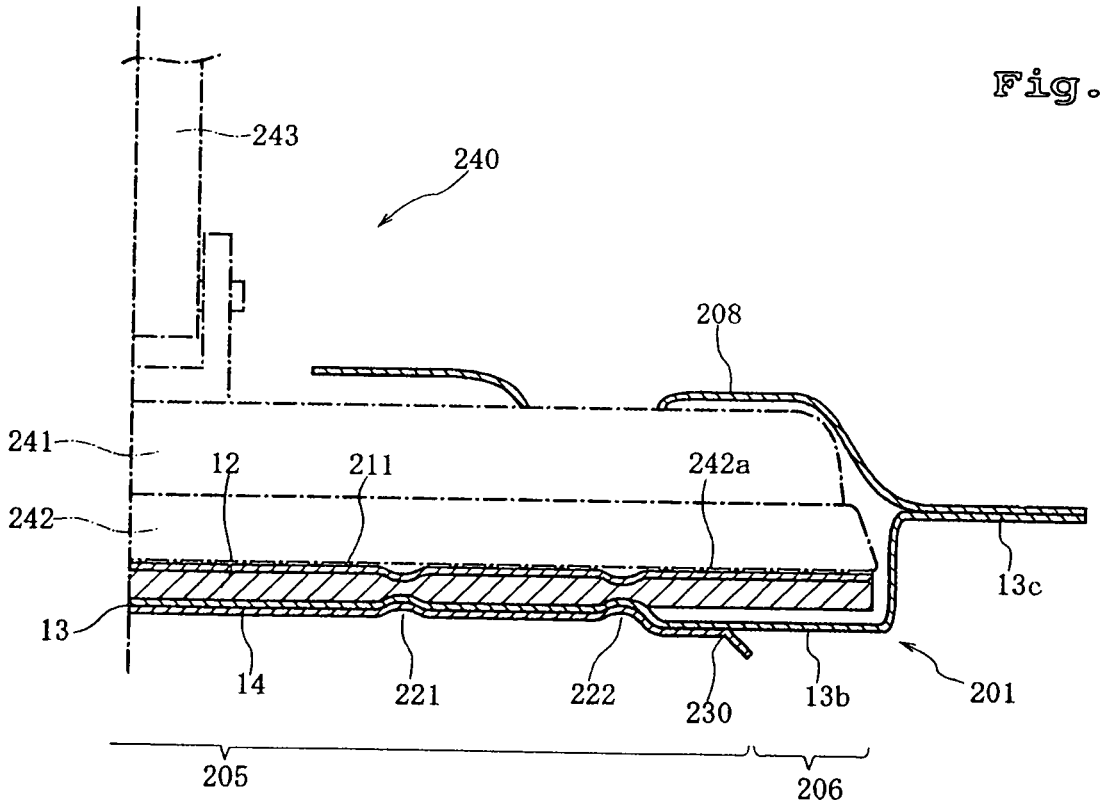
FIG. 8 is a half sectional view showing a state where the cleaning sheet of FIG. 7 is mounted on a holder.

FIGS. 7 and 8 show a cleaning sheet 201 according to a third embodiment of the present invention.

The cleaning sheet 201 has a first cleaning region 205 and second cleaning regions 206. In a holder 240 to which the cleaning sheet 201 is intended to be attached, a support plate 241 is pivotally connected to a leading end of a handle 243 and a support member 242 is fixed beneath the support plate 241. The first and second cleaning regions 205, 206 of the cleaning sheet 201 are located on a lower surface 242*a* of the support member 242.

In the cleaning sheet 201, the liquid retaining member 12 extends from the first cleaning region 205 to the second cleaning regions 206. The cleaning surface of the liquid retaining member 12 is covered with the nonwoven fabric 13 such as through-air bonded nonwoven fabric. In the first cleaning region 205, the topsheet 14 is located on the cleaning surface of the nonwoven fabric 13. On the holding surface of the liquid retaining member 12 is provided a liquid-permeable or liquid-impermeable backsheet 211. The topsheet 14, the nonwoven fabric 13, the liquid retaining member 12 and the backsheet 211 are joined together at compression joins 221, 222.

Laterally outside the compression joins 222, the topsheet 14 and the nonwoven fabric 13 are fixed together by fusion bonding or adhesive bonding to have joins 230. In the second cleaning regions 206, the nonwoven fabric 13 is exposed externally on the cleaning surface-side of the liquid retaining member 12 to provide the fibrous wiper portions 13*b*.

The nonwoven fabric 13 further extends laterally beyond the second cleaning regions 206 to provide extension regions 13*c* which is continuous with the fibrous wiper portions 13*b*. Additional nonwoven sheets are joined to the extension region 13*c* to thereby provide attachment regions 208.

As shown in FIG. 8, when the attachment regions 208 of the cleaning sheet 201 are secured to the upper surface of the support plate 241, the first and second cleaning regions 205, 206 of the cleaning sheet 201 are positioned on the lower surface 242*a* of the support member 242. Since the through-air bonded nonwoven fabric 13 and the topsheet 14 are located on the cleaning surface-side of the liquid retaining member 12 in the first cleaning region 205, liquid adhered to a floor surface or the like can pass through the topsheet 14 and the nonwoven fabric 13 and be then absorbed and retained in the liquid retaining member 12. When a pressure is exerted on the first cleaning region 205, on the other hand, liquid retained in the liquid retaining member 12 can ooze out of the topsheet 14, enabling effective wiping with the topsheet 14.

On the other hand, since the through-air bonded nonwoven fabric 13 is exposed externally in the second cleaning regions 206 to provide the fibrous wiper portions 13*b*, relatively large refuse can be effectively collected with the fibrous wiper portions 13*b* containing less water.

In the third embodiment shown in FIGS. 7 and 8, the liquid retaining member 12 may be partially or wholly omitted from the second cleaning regions 206. In FIG. 8, for example, the right edge of the liquid retaining member 12 may be spaced inwardly from the right edge of the lower surface 242*a* of the support member 242.

The cleaning sheet of the present invention may be modified such that there is no difference in structure between two sides of the cleaning sheet. In embodiment shown in FIG. 2, for example, the substrate sheet 11 may be replaced by another nonwoven fabric 13 and another topsheet 14 to provide additional buffer regions 7, 7 and additional second cleaning regions 6, 6 on the lower side of the drawing. This makes the cleaning sheet reversible.

Although the present invention has been illustrated and described with respect to exemplary embodiments thereof, it should be understood by those skilled in the art that the foregoing and various other changes, omission and additions may be made therein and thereto, without departing from the spirit and scope of the present invention. Therefore, the present invention should not be understood as limited to the specific embodiments set out above but to include all possible embodiments which can be embodied within a scope encompassed and equivalent thereof with respect to the features set out in the appended claims.

What is claimed is:

1. A cleaning sheet having a cleaning surface intended to come into contact with an object to be cleaned and a holding surface opposite from the cleaning surface, the cleaning sheet comprising a liquid-permeable topsheet on the cleaning surface; a substrate sheet on the holding surface; and a liquid retaining member and a non-woven fabric sheet disposed between the topsheet and the substrate sheet;

the topsheet comprising hydrophilic synthetic resin fibers;

wherein said cleaning sheet comprises a first rectangular cleaning region in which the topsheet, the substrate sheet, the liquid retaining member and the non-woven fabric sheet are present, and wherein said cleaning sheet further comprises two rectangular second cleaning regions, each disposed along opposite sides of the first cleaning region, said second cleaning regions comprising said topsheet, said non-woven fabric sheet and said substrate sheet, but not said liquid retaining member, and wherein said cleaning sheet further comprises third rectangular cleaning regions, each disposed along opposite sides of said second cleaning regions, said third cleaning regions comprising said substrate sheet and said non-woven fabric sheet, but not said topsheet and not said liquid retaining member;

and wherein said substrate sheet comprises two attachment regions each disposed along opposite outer long sides of said third cleaning regions, said attachment regions adapted to be attached to a top surface of a cleaning device.

2. The cleaning sheet according to claim 1, wherein the topsheet consists essentially of synthetic resin fibers.

3. The cleaning sheet according to claim 2, wherein the topsheet includes microfibers having a fineness of 0.011 to 0.77 dtex.

4. The cleaning sheet according to claim 3, wherein the topsheet further includes relatively thick fibers having a fineness of 1.1 to 5.5 dtex, wherein the relatively thick fibers and the microfibers are split from common original fibers.

5. The cleaning sheet according to claim 2, wherein the topsheet is a nonwoven fabric in which the synthetic resin fibers are entangled.

6. The cleaning sheet according to claim 1, wherein at least the topsheet and the substrate sheet are joined together along boundaries between the first cleaning region and the second cleaning regions.

7. The cleaning sheet according to claim 6, wherein said second cleaning regions constitute buffer regions where the liquid retaining member is not present, the buffer regions are provided between the first cleaning region and the third cleaning regions and at least the topsheet and the substrate sheet are joined together along boundaries between the first cleaning region and the buffer regions and along boundaries between the buffer regions and the third cleaning regions.

8. The cleaning sheet according to claim 1, wherein the first cleaning region and the two third cleaning regions respectively occupy 50-70% and 10-50% of sum of surface areas of the first cleaning region and the two third cleaning regions.

9. The cleaning sheet according to claim 1, wherein at least the topsheet and the substrate sheet are joined along boundaries between the second cleaning regions and the third cleaning regions.

* * * * *